United States Patent [19]

Madsen

[11] 3,982,581

[45] Sept. 28, 1976

[54] DRAPERY HANGER AND MANIPULATOR

[76] Inventor: Harold L. Madsen, 14615 S. Clark St., Dolton, Ill. 60419

[22] Filed: Dec. 18, 1974

[21] Appl. No.: 533,872

[52] U.S. Cl. ..... 160/340; 160/348

[51] Int. Cl.[2] ..... A47H 5/00; A47H 13/14

[58] Field of Search ..... 160/330, 340, 348, 166 A, 160/344, 342, 237, 219

[56] References Cited

UNITED STATES PATENTS 3,844,330 10/1974 Hyman ..... 160/166 A

*Primary Examiner*—Philip C. Kannan
*Assistant Examiner*—D. Robinson
*Attorney, Agent, or Firm*—Evan D. Roberts

[57] ABSTRACT

A drapery hanger and manipulator is disclosed herein having drapery panels or segments suspended on respective drapery holders which are independently mounted on a supporting frame.

6 Claims, 17 Drawing Figures

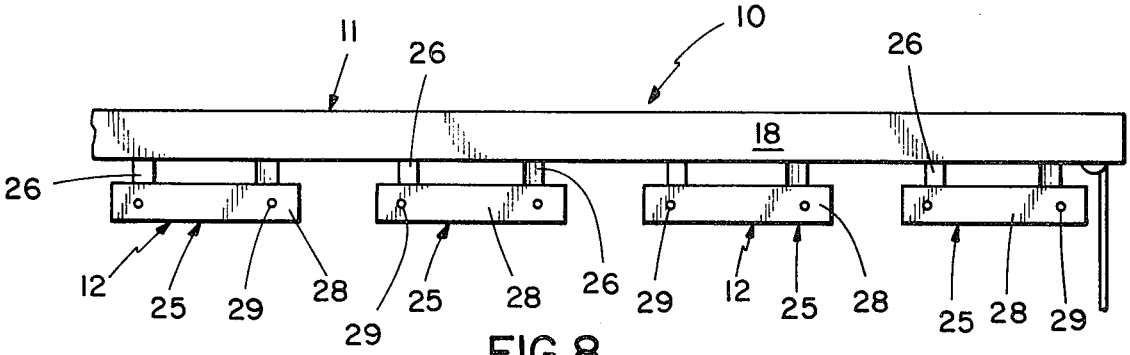
FIG.8
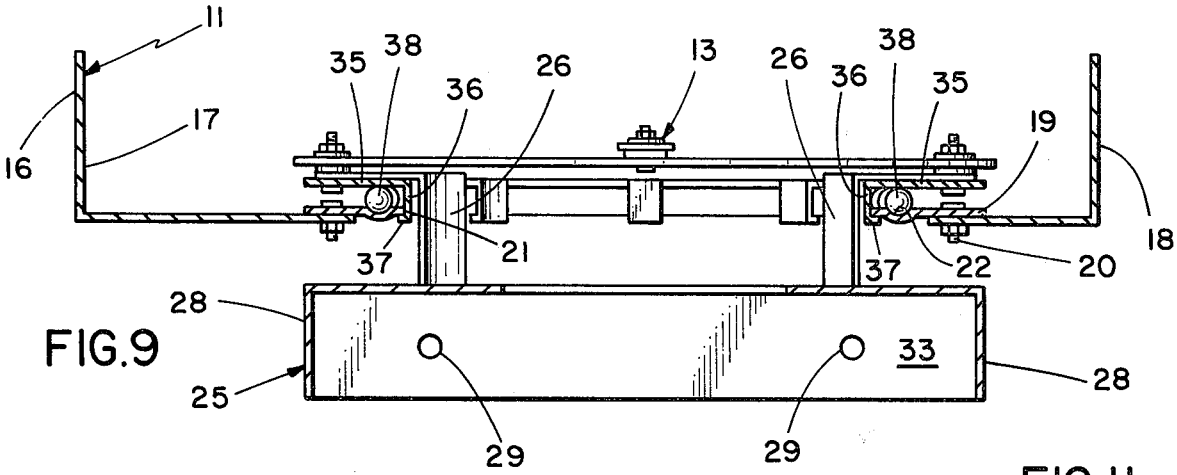
FIG.9
FIG.10
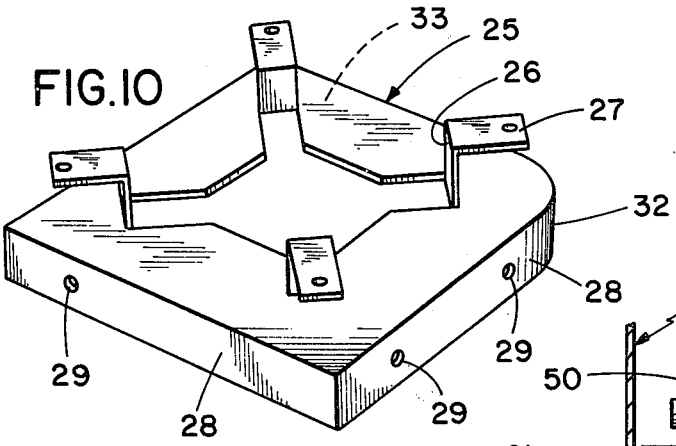
FIG.11
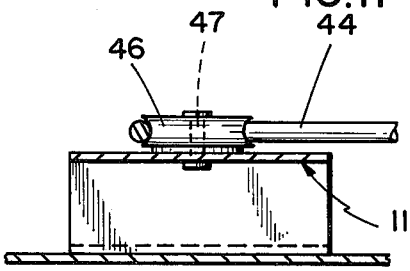
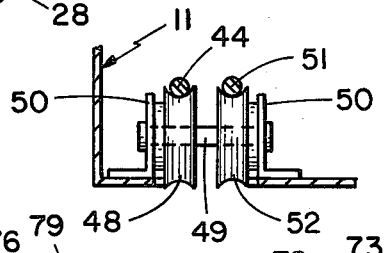
FIG.12
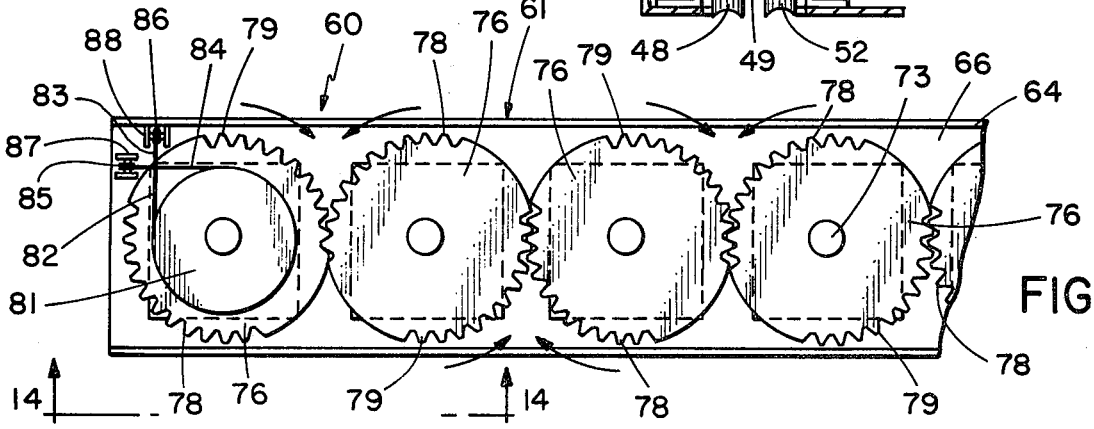
FIG.13

DRAPERY HANGER AND MANIPULATOR

SUMMARY OF THE INVENTION

This invention relates to an improved drapery hanger and manipulator for supportably hanging and manipulating one or more drapery curtains, in a possible series of drapery curtain panels, by means of drapery curtain holders moveably or, more specifically, rotatably mounted on a frame and adapter to hold individual drapery curtain panels in a vertically suspended fashion and in vertical planes at some angle to, and adjacent to, an area to be covered by the drapery curtain, whereby, by means of a manipulating means, interconnecting the frame and the drapery curtain holders, the individual drapery curtain panels can be angularly repositioned with respect to the area to be covered by the drapery curtain.

In the known types of drapery or curtain supporting and manipulating devices, it is a common facility thereof to provide some means by which draperies or curtains can be manipulated from side-to-side or from top-to-bottom over an area to be covered by the drapes or curtains. To accomplish this, the drapery holders in the known types of devices, slide or otherwise merely more the drapes or the curtains to and fro completely across the opening to be covered thereby.

It is a general primary object of the drapery hanger and manipulator of this invention to provide a drapery curtain hanger and manipulator which, when operated, will provide for selectively positioning of independent segments of drapery curtain, angularly and horizontally over the area to be covered thereby. In this structure, drapery curtain panels may be individually angularly and horizontally positionable with respect to the area to be covered.

Further, it is an object of this invention to provide the drapery hanger or manipulator wherein a series of drapery curtain panels can be utilized to cover and uncover an area according to the capabilities and characteristics of the individual curtain panels, or even sub-segments thereof, without requiring movement of the drapery material from remote side, top, bottom or central locations entirely across the area to be covered, thereby eliminating the necessity for complete side-to-side or top-to-bottom movement of drapery panels to effect drapery curtain coverage of a given area.

A more specific object of this invention, is to provide a drapery hanger and manipulator wherein one, or a series of drapery curtain panels, are located in a position over an area to be covered thereby, and the panels are, by virtue of the structures of this invention, manipulatable, substantially in place, or at stations to selectively provide the drapery effects provided in the respective segmented portions of the drapery curtain panels.

Other advantages and novel aspects of this invention will become apparent from the following details description, in conjunction with the accompanying drawings wherein.

FIG. 8 is a partial front elevational view taken along line 8—8 of FIG. 5 showing the position of the drapery curtain holders with respect to the frame with the drapery curtain panels removed from the holders.

FIG. 9 is a sectional view taken along line 9—9 of FIG. 5 showing the detailed interrelationship of the drapery curtain holders and the holder manipulating structure of the first embodiment of this invention.

FIG. 10 is an isometric view of the holder portion of the drapery curtain holder means to which the drapery curtains are attached.

FIG. 11 is a partial sectional view taken along line 11—11 of FIG. 5 showing the details of a pulley of the holder manipulating means for reversing the direction of the cables utilized to actuate the holder manipulator.

FIG. 12 is a partial sectional view taken along line 12—12 of FIG. 5 showing the details of pulleys of the holder manipulating means for reversing the direction of the cables utilized to actuate the holder manipulator.

FIG. 13 is a partial top plan view of a second embodiment of the drapery hanger and manipulator of this invention showing an intermeshed gear means for manipulating the holder.

Figure 1:
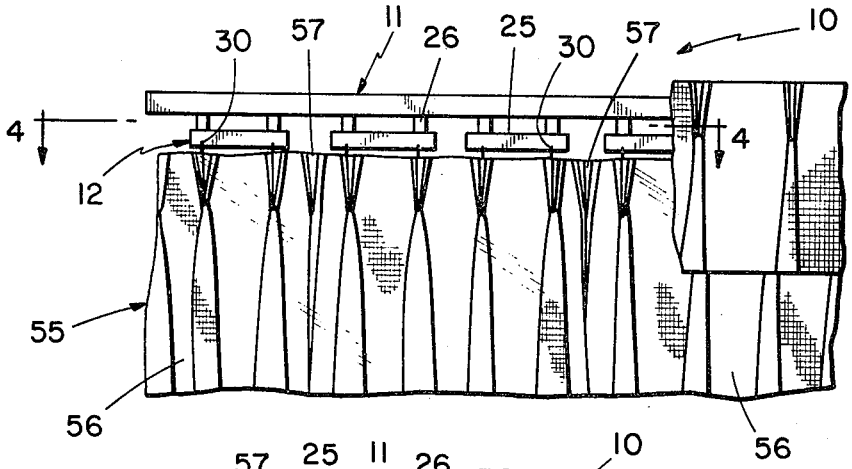
FIG. 1 is a front elevation view of the first embodiment of the drapery hanger and manipulator of this invention showing the drapery curtain hangers supporting relatively opaque segments of drapery curtain panels from the frame in position over an area to be covered thereby.
Figure 2:
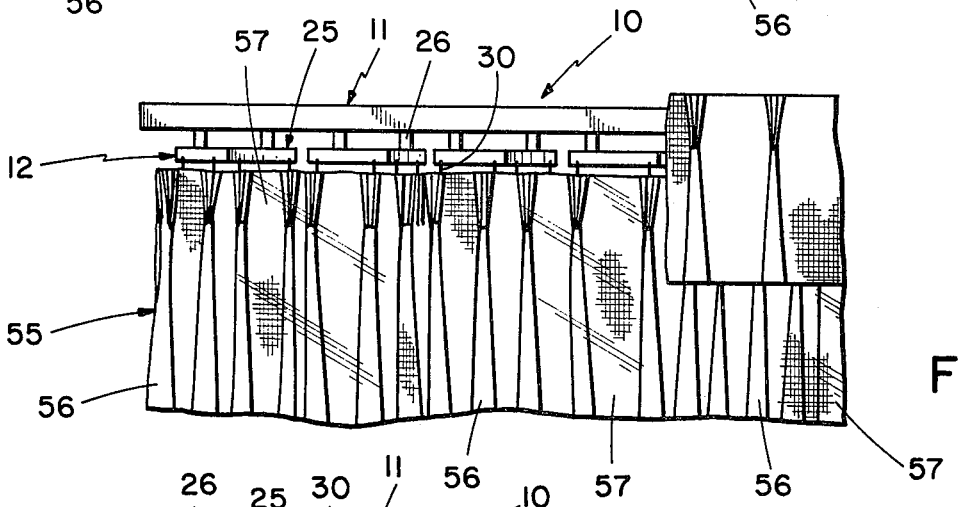
FIG. 2 is a front elevation view of the first embodiment of the drapery hanger and manipulator of this invention showing relatively opaque segments of drapery curtain panels as well as transparent drapery curtain panels in a position over the area to be covered thereby.
Figure 3:
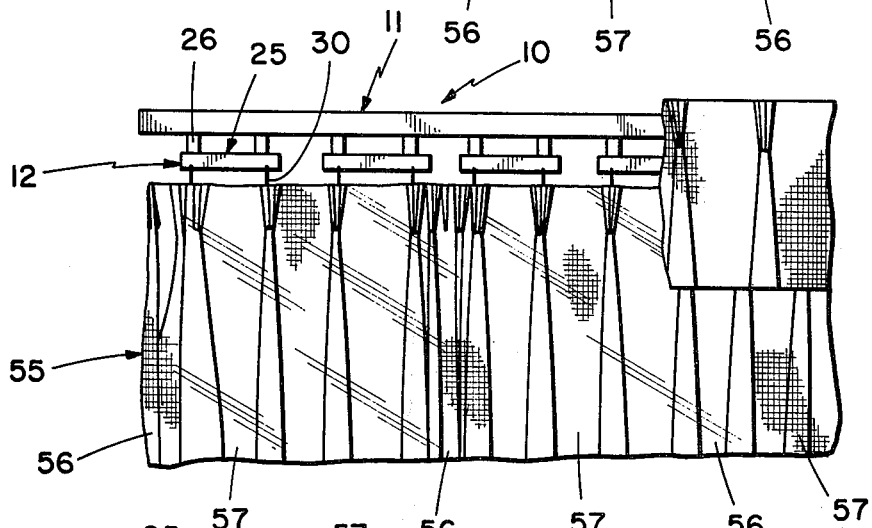
FIG. 3 is a front elevation view of the first embodiment of the drapery hanger and manipulator of this invention showing relatively transparent segments of drapery curtain panels in position over the area to be covered thereby.

A first embodiment of the drapery hanger and manipulator of this invention is disclosed in FIGS. 1–12 and is generally illustrated by the numeral 10. This first embodiment includes, generally, frame 11, drapery curtain holder means 12 and a holder manipulator means 13.

Frame 11 may be adapted by any suitable means (not shown) to secure same to a wall or other structure 15 (FIGS. 5–7) over an area to be covered by a drapery curtain, with back surface 16 thereof adjacent wall or other surface 15. Frame 11, generally comprises an L-shaped channel 17, an L-shaped front channel 18 rigidly inter-connected by a series of longitudinally spaced apart plates 19 (FIG. 6) spanning channels 17 and 18, and secured thereto by bolts or similar means 20 (FIG. 9). Each plate 19 is provided with a central aperture 21, and a bearing raceway 22 therearound (FIG. 9). It should be noted that either of channels 17 and 18 can be utilized as front or back channels as desired.

Drapery curtain holder means 12, one of which is illustrated in detail in FIG. 9, includes, generally, a series of drapery curtain holders or retainers having four upwardly extending angle brackets 26, positioned within respective plate apertures 21 and having a top flange portion 27 extending radially outwardly over bearing race 22. Each holder 25 is provided with adjacent side walls 28 and 33, separated by rounded channel clearance portion 32 and adapted with apertures 29 to retain drapery curtain hooks 30 (FIGS. 1–3) attached to drapery curtains 31. Holder brackets 26 (FIG. 9) of each holder 25 are positioned with portion 27 over an upper bearing race plate 35 with downwardly extending section 36 through aperture 21 and under the aperture edge 21 of plat 19 by section 37 to enclose ball bearings 38 therebetween whereby, holders 25, through brackets 26 thereof, are rotatably supported on roller bearings 38 between plates 19 and 35 to allow rotation of respective holders 25 within apertures 21 of plates 19.

Successive adjacent pairs of drapery curtain holders 25 (FIGS. 5–7 and 9) are interconnected and operated by manipulator means 13 having a cross link 40. It should be noted that cross link 40 (FIG. 7), interconnects the lower left of holder bracket 26, of the left drapery curtain holder 25, with the upper left bracket 26, of the right drapery curtain holder 25, of each successive pair of drapery curtain holders, by a connecting pin 41. Each cross connecting link 40 is pivotally attached, near the center thereof, with a master actuating link 42 by respective interconnecting pins 43. A first actuating cable 44 is attached (FIGS. 5–7 and 11) at the right of master link 42 by pin 45. Cable 44 is supported on a direction reversing pulley 46, rotatably supported on shaft 47 secured to frame 11 (FIG. 11), and is positioned over a pulley 48 rotatably mounted on a shaft 49 in brackets 50 and positioned over a frame hole 53 and to a vertical suspended position. A second or reversing cable 51 (FIGS. 5–7 and 12) is connected to pin 43 at the left of master actuating link 42 (FIGS. 5–7) and is suspended over a pulley 52 (FIGS. 5–7 and 12), through hole 53 and positioned adjacent the area to be covered by the drapery curtains. Pulley 52 is rotatably mounted on shaft 49 secured between support brackets 50 (FIG. 12).

Figures 5, 6, 7:
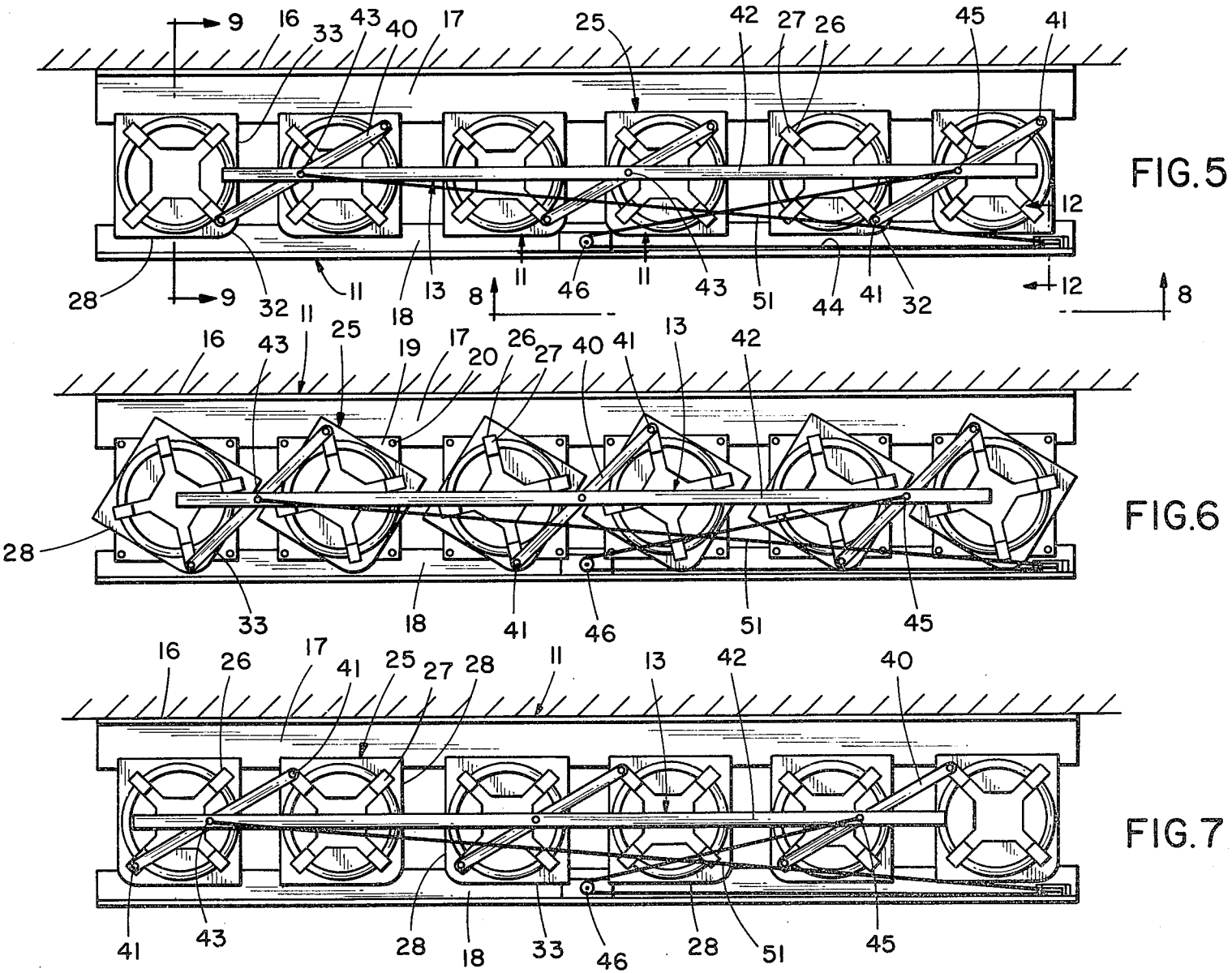
FIG. 5 is a top view of the first embodiment of the drapery hanger and manipulator of this invention, shown in FIG. 1, illustrating the holder manipulating means interconnecting the drapery holders and the frame with the holders in an initial position.
FIG. 6 is a top view like that of FIG. 5 with the holder manipulator means partially actuated to show the drapery curtain holders moved from the initial position, shown in FIG. 5 to an intermediate position.
FIG. 7 is a top plan view like that of FIGS. 5 and 6 wherein the holder manipulating means is fully actuated to the left to move the drapery curtain holders from the initial and intermediate positions to a final position, with the drapery curtain holders rotated 90° from the position shown in FIG. 5.

It should be noted, that by pulling downwardly on the first or actuating cable 44, cable 44 will be drawn over pulley 46 and 48 and will urge master link 42 to the left (FIGS. 7–9). By pulling downwardly on second or reversing cable 51, cable 51 will be drawn around pulley 52 and urge master actuating link 42 to the right.

Drapery curtain material, generally designed as 55, (FIGS. 1–4) is attached to holders 25, by drapery hangers 30 with primary segments 56, normally exposed to the front, and secondary segments 57, normally positioned between adjacent pairs of holders 25 (FIG. 1). Drapery curtain segments 56 and 57 can be of independent texture, color and opaqueners. A valance 58 is shown to be attached to channel 19 on the front of frame 11 in any conventional manner (not shown) to enclose the drapery hanger and manipulator 10 of this invention.

In operation, the first embodiment 10 of the drapery hanger and manipulator of this invention is normally in a fully closed position (FIG. 1) or a fully open position (FIG. 3), and for purposes of describing the operation thereof, hanger and manipulator 10 will be considered to be first in the fully closed position. In the closed position, manipulator 10 displays opaque drapery curtains 56 on hangers 30 (FIGS. 1 and 4) on the forward side of holders 25 whereby drapery curtains 56 will present an opaque or closed condition across the length of manipulator 10 to constitute the closed position thereof.

Figure 4:
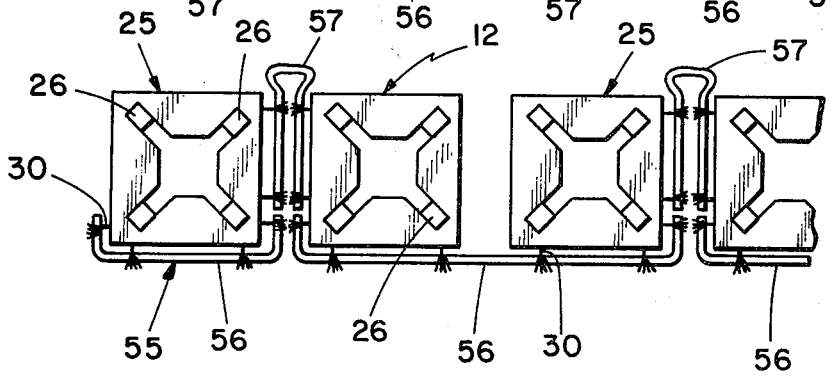
FIG. 4 is a partial sectional view taken along 4—4 of FIG. 1 showing the position of the drapery curtain panel segments with respect to the drapery curtain holders.

Segments 57 are preferably translucent and possibly of a different color than segments 56 and are supported on holders 25 by hangers 30, between alternate pairs of hangers (FIG. 4) segments 57 are thereby substantially retained at 90° with respect to the closed surface provided by segments 56 (FIGS. 1 and 4). Translucent segments 57 thus do not present themselves as part of the drapery material in the closed position of manipulator 10.

To operate manipulator 10 to cause same to go from a closed position (FIGS. 1 and 4) to an open position (FIG. 3), first actuating cable 44 is drawn downwardly over pulley 48 (FIGS. 5–7 and 12). Cable 44 will be moved around pulley 46, drawing link 42 to the left (FIG. 5). Continued downward movement of cable 44 will cause link 42 to move through an intermediate position (FIG. 6), carrying cross lengths 40 therewith, which in turn wil cause alternate holders 25 to rotate in alternately opposite directions.

In particular, leftward movement of link 42, carrying links 40 therewith, will urge the holder on the left to be rotated clockwise as indicated, the next adjacent holder on the right thereof will be rotated counterclockwise, as indicated and similarly alternately throughout the series of holders 25 proceeding to the right, as indicated. During this intermediate positioning, holders 25 will be rotated between 0° and 90° and midway in this movement segments 56 will be partially rotated out of the plan shown (FIG. 4) and curtain drapery segments 57 will be similarly moved into partial view from the position shown (FIG. 4) to that shown in FIG. 2.

Continued and final movement of cable 44 downwardly will cause link 42 to move completely to the left (FIG. 7) whereupon the links 40, carried with link 42, will complete the alternate clockwise and counterclockwise rotation of holders 25. Drapery curtain segments 56, originally contained in the plan shown (FIG. 4) will be rotated to alternate positions adjacent holder 25 in much the same fashion as segments 57 were originally positioned, only in the alternate spaces originally unoccupied by segments 57.

As segments 56 are thus rotated, curtain drapery segments 57 are also rotated from the alternate position between holders 25 (FIG. 4) to the position originally occupied by segments 56, to substitute for segments 56 and to, accordingly, substitute the curtain or screen effect inherent in 57 for the screening or curtain effect originally provided by segments 56.

Thus, the first embodiment 10 of the drapery hanger and manipulator of this invention, as well as other embodiments thereof hereinafter set forth, provide a drapery curtain hanger and manipulator which, when operated, will selectively position independent segments of drapery curtain angularly and horizontally over an area to be covered thereby, in a fashion such that the drapery curtain panels may be individually and angularly and horizontally positionable with respect to the area to be covered.

Also, a drapery hanger and manipulator is provided wherein a series of curtain panels are utilized to cover and uncover an area according to the inherent capabilities and characteristics of the individual curtain panel or sub-segments thereof, without requiring movement of the drapery material completely from side-to-side or from top-to-bottom. Instead, this invention provides a drapery curtain manipulator wherein curtain segments are readily rotatable on independent hangers to provide an opening and closing, or a change of color or density effect without requiring substantial transitional movement of entire curtain sections.

In summary, drapery curtain segments may be manipulated and positioned over an area to be covered by virtue of the structures of the first embodiment 10 of the drapery hanger and manipulator of this invention whereby curtain segments are manipulatable substantially in place or at stations to selectively provide the drapery effects that can be selectively provided in segmented portions of the drapery curtain.

Figure 14:
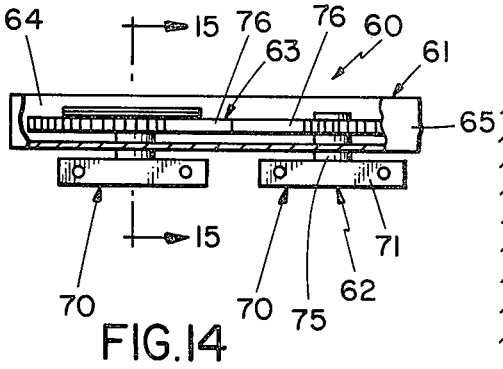
FIG. 14 is a partial sectional view taken along line 14—14 of FIG. 13 showing the details of the structural interrelationship of the drapery curtain holders and the holder manipulating means supported on the frame.
Figure 15:
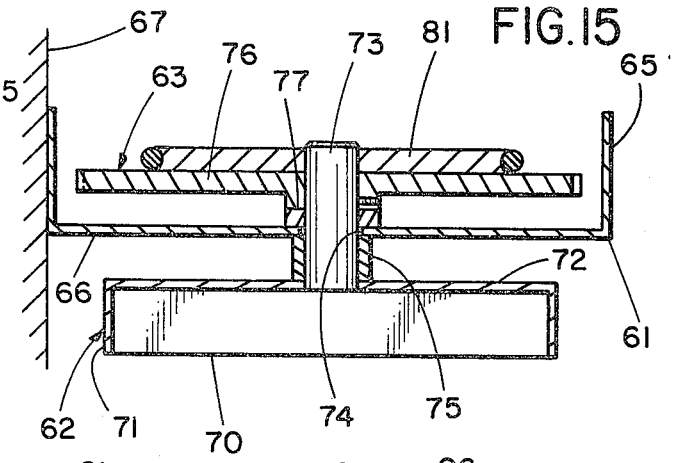
FIG. 15 is a sectional view taken along line 15—15 of FIG. 14 showing the details of the structural interrelationship of the holder manipulating means, drapery curtain holders, and the supporting frame therefor.

A second embodiment of the drapery hanger and manipulator of this invention is disclosed in FIGS. 13–15 and is generally illustrated by the numeral 60. This second embodiment includes, generally, frame 61, drapery curtain holder means 62 and a holder manipulating means 63. Frame 61 has a general U-shaped channel configuration having a back panel 64, front panel 65 and bottom panel 66. Back panel 64 is adapted to be secured to the wall 67 over the area to be covered by the draperies held by the hanger and manipulator 60.

Drapery holder means 62 includes holders 70 having side panels 71 and a top portion 72 and individually mounted on a shaft 73 positioned in an aperture 74 in bottom panel 66 of frame 61, and extending therethrough into frame 61. A spacing sleeve 75 is provided between each holder plane 72 and frame bottom panel 66, and a gear wheel 76 having hub 77 is secured on shaft 73 to positioned shaft 73 axially in aperture 71.

Each gear wheel 76, secured to respective shaft 73, is provided with gear segments 78 adapted to meshingly engage a similar gear segment 79 of adjacent wheel (FIGS. 13 & 14). Left most gear wheel 76 (FIG. 13) is provided with a drive pulley 81 secured thereto and adapted to receive a cable 82 therearound.

Cable 82 has the respective end portions 83 and 84 thereof positioned on pulleys 85 and 86 supported on brackets 87 and 88 on frane 61 whereby, when the upper end 83 of cable 82 (FIG. 13) is pulled downwardly, first wheel 76 on the left will be rotated clockwise, as indicated, and each wheel of the series will be rotated in alternate directions as a result of the intermeshing of gear segments 79 and 78 thereof.

Similarly, when the left end 84 of cable 82 is pulled downwardly over pulley 85, the left most wheel 76 will be rotated in a counter-clockwise direction and the remaining wheels 76 in the series will be alternately rotated in opposite directions, all opposite to that shown. Thus, the drapery holders 62 of the second embodiment 60 of the drapery hanger and manipulator of this invention will be operated in much the same manner as are the drapery holders 25 of first embodiment of this invention, with all the resulting advantages and novel aspects thereof, as the cables are actuated as indicated above.

Figure 16:
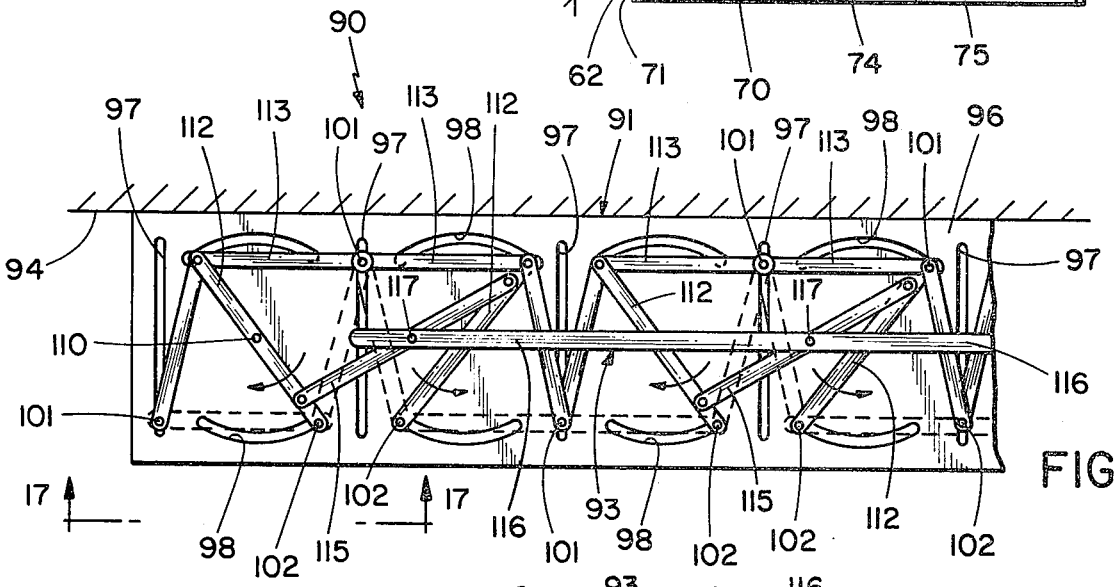
FIG. 16 is a partial top plan view of the third embodiment of the drapery hanger and manipulator of this invention showing the details of the holder manipulating linkage thereof.
Figure 17:
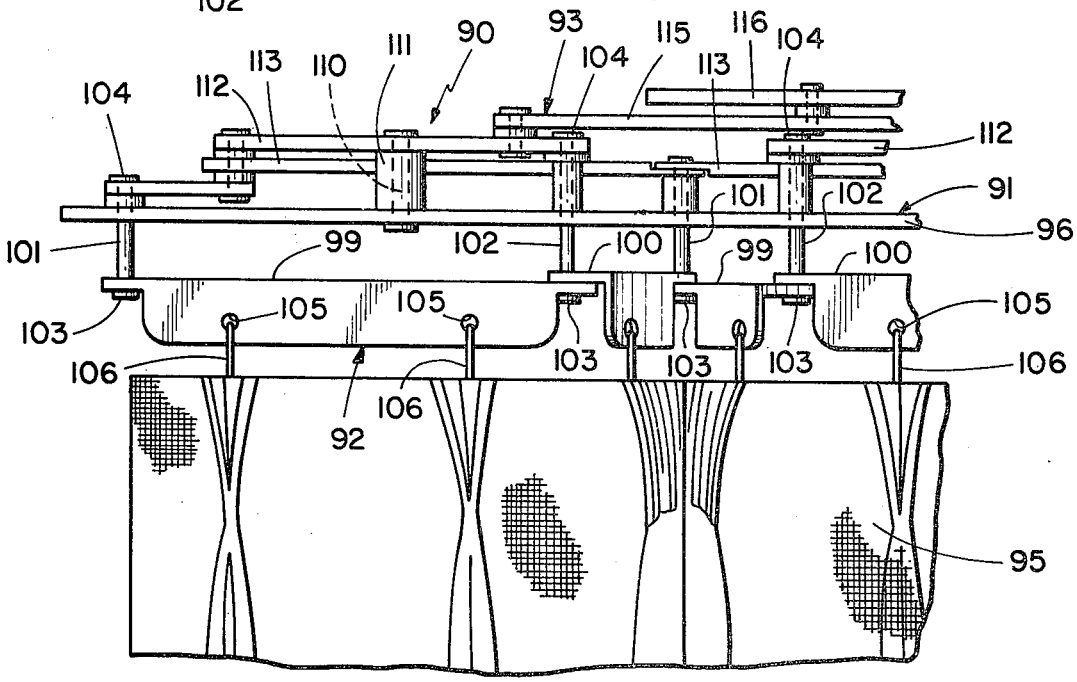
FIG. 17 is a partial front elevation view taken along line 17—17 of FIG. 16 showing the details of the drapery curtain holders and the holder manipulating means therefor, with the holders in the first position.

A third embodiment of the drapery hanger and manipulator of this invention is disclosed in FIGS. 16 and 17 and is generally illustrated by the numeral 90. This third embodiment includes, generally, a frame 91, drapery curtain hanger means 92 and a holder manipulating means 93.

Frame 91 may be adapted by any suitable means (not shown) to secure same to a wall or other structure 94 over an area to be covered by a drapery curtain 95. Frame 91 generally comprises a plate 96 divided into stations by lateral slots 97 longitudinally spaced therealong, as well as by pairs of opposed arcuate slots 98 respectively longitudinally spaced along frame 96 between slots 97. Drapery hanger means 92, of third embodiment 90 of this invention, includes a chain of L-shaped hangers 99 and 100, alternately interconnected by short and long pins 101 and 102 having heads 103 on the bottom thereof to support hangers 99 and 100 and heads 104 on the top thereof to respectively support pins 101 and 102 and the linkages of holder means 93. Each hanger 99 and 100 is provided with a pair of apertures 105 for supporting drapery curtain material on hook 106 insertable therein.

At each of the stations on frame 91 and centrally located therein, a pivot pin 110 is supported in a stub spacer 111 to provide a pivot for rotating lengths 112 respectively mounted on the ends of pins 110 at each of the stations. Each rotating link 112 is pivotally connected to one of the long pins 102 extending from the interconnection between 99 and 100, through slot 98 and rotating link, at the front (bottom of FIG. 16) of frame 91. The opposite end of each of the rotating links 112 is pivotally connected to a pair of slot guide links 113, one of which is adapted at the opposite end thereof to be pivotally connected to one of the short pins 101 slidably positioned in slot 97 of frame 91. The other of each pair of slot links 113 is adapted at the other end thereof to similarly connect to one of the short pins 101 similarly slidably positioned in the other adjacent slot 97 of the station of the respective rotating link 112 thereof to which slot links 113 are pivotally attached by pin 101.

A cross actuating link 115 is pivotally connected to adjacent pairs of rotating links 112 and alternately adjacent the front and rear portions of said adjacent rotating links 112 ( FIGS. 16 & 17). A primary actuating link 116 interconnects all cross links 115 midway in the cross links by pin 117 pivotally interconnected therebetween whereby when actuating link 116 is moved, either to the left or to the right, cross links 115 will be directly carried therewith by the interconnecting pin 117.

In operation, the third embodiment 90 of the drapery hanger and manipulator of this invention is actuated in much the same fashion as the first embodiment, with pulleys and cables affixed to and otherwise associated with the frame 91 thereof for the sole purpose of moving actuator link 116 to the left and to the right along frame 91. Inasmuch as the cable and pulley mechanism are described in detail with respect to the first embodiment of this invention, the structures are not here again repeated but are assumed to be provided in the same fashion for the sole purpose of selectively moving actuator link 116 to the left and to the right to actuate holder manipulating means 93. In this regard, it should be noted that, for the purpose of this invention, the third embodiment hereof could be actuated manually by moving actuator bar 116 directly manually to the left and to the right. However, it may be desirable to utilize cables and pulleys as was described with respect to the first embodiment, to provide the actuation of primary actuator link.

Generally, in regard to operation of the third embodiment 90, hangers 99 and 100 are alternately moved from a position somewhat lateral to the frame 91 to a position parallel to frame 91 thereby selectively presenting two alternative drapery curtain materials to be exposed to the front of frame 91 for whatever effects the selected drapery curtain may have to provide.

In the positions shows (FIGS. 16 and 17) those links 99 and 100 which are exposed to the front of frame 91 will be moved to a position substantially, or at least somewhat lateral, to frame 91 and the other of the hangers 99 and 100, which are positioned somewhat laterally with respect to frame 91, will be rotated to a position parallel to the front of frame 91, all as actuating link 116 is moved to the left. The reverse will therefore take place when link 116 is moved to the right. In particular, the left most hanger 99 is shown positioned parallel with respect to the front of frame 91, however, when actuator bar 116 is moved to the left, cross link 115 carried therewith, will urge adjacent rotating links 112 to rotate in opposite directions as shown. Specifically, the left most rotating link will be rotated clockwise as shown (FIG. 16) while movement of link 116 and cross link 115 to the left will cause adjacent rotating link 112, to the right thereof, to be rotated counterclockwise as shown (FIG. 16).

As a result of this opposite rotation of adjacent rotating links 112 holders 99 and 100, which were parallel and adjacent to the front of frame 91, will be rotated by action of rotating links 112, pulling and pushing on links 99 and 100 so that these links 99 and 100 will be rotated to a position adjacent lateral slot and thus will be rotated to a position somewhat lateral to frame 91 rather than parallel to the front thereof.

Conversely, during this leftward movement of actuator link 116, the holders 99 and 100 which are positioned somewhat laterally to frame 91 will be moved and rotated, in the same manner, to the position parallel and adjacent the front of frame 91 as vacated by the holders 99 and 100 moved away therefrom.

Similarly, actuating link 116 and its cross links 115 can be moved to the right, causing the reverse reorientation of holders 99 and 100 whereby all holders which are positioned somewhat laterally to frame 91 will be moved to a position parallel with the front of frame 91, and holders 99 and 100 positioned parallel with front of frame 91 will be moved to a position somewhat lateral to frame 91, by the cooperating pushing and pulling effect of the cross link ends of rotating links 112.

Thus, it can be seen that by alternately moving actuating link 116 to the left and then to the right, adjacent holders 99 and 100 will be manipulated between lateral and longitudinal positions to either remove the curtain materials hung therefrom from the front of frame 91 or to move the curtain materials hung therefrom into position on the front of frame 91 to accordingly remove the curtain materials from view or to present the curtain materials in full view and in full curtain effect.

It is to be understood that the invention is not to be limited to the specific constructions and arrangements shown and described, as it will be understood to those skilled in the art that certain changes may be made without departing from the principles of the invention.

What is claimed is:

1. A drapery hanger and manipulator for supportably hanging and manipulating one or more drapery curtain panels comprising a frame adapted to be positioned above an area to be covered by a drapery panel, a drapery curtain holder means movably mounted on said frame and adapted to hold a drapery curtain panel in a vertically suspended fashion at an angle and in a horizontally adjacent position with respect to said area to be covered by the drapery curtain, said holder means having a drapery curtain holder extending from said frame and having drapery curtain retaining means on two adjacent angularly disposed sides thereof to hold corresponding adjacent portions of the drapery curtain panels at an angle therebetween, and a holder manipulating means interconnecting said frame and said holder means and adapted to move said holder means on said frame for selectively adjusting said angle of said drapery curtain and said position of said drapery curtain panel with respect to said frame, whereby the drapery curtain panel and the angularly disposed portions thereof are independently angularly and horizontally positionable with respect to the area to be covered thereby.

2. A drapery hanger and manipulator as defined in claim 1 wherein said holder means comprises a pair of adjacent holders and said manipulating means is adapted to simultaneously rotate said holders in opposite directions to alternately position said two sides over said drapery curtain area.

3. a drapery hanger and manipulator as defined in claim 1 wherein said holder means comprises a series of pairs of holders and said manipulating means is adapted to simultaneously rotate the holders of each pair of holders in opposite directions to alternatably position said two sides over said drapery curtain area.

4. A drapery hanger and manipulator as defined in claim 3 wherein said manipulating means comprises a master link extending centrally along said series of holders, and a cross link for each pair of holders, said cross links being respectivelly pivotally connected centrally thereof to said master link between holders of said pairs of holders and pivotally connected at the ends thereof to opposite sides of respective holders of each pair of holders, whereby movement of said master link along said holders will cause said cross links to urge said series of holders in alternately opposite rotational directions to manipulate said curtains held by said holders.

5. A drapery hanger and manipulator as defined in claim 3 wherein said manipulating means comprises a series of intermeshing gears respectively secured to said series of holders to rotate therewith, and a means for rotating one of said gears in either rotational direction, whereby said intermeshing gears are rotatable in opposite directions for urging said series holders in alternately opposite rotational direction to manipulate said curtains held by said holders.

6. A drapery hanger and manipulator as defined in claim 3 wherein said frame is provided with laterally extending slots through said frame and in spaced apart position longitudinally therealong and respectively adjacent both longitudinal sides of each of said holders, said frame being further provided with a pair of circular slots therethrough adjacent lateral sides thereof between each and said lateral slots and respectively centered on the rotational axis of said holders; said holders each comprise a pair of hangers pivotally interconnected by hanger pins; said hanger pins extending upwardly and respectively through the circular slot of each pair of circular slots along one side of said frame, said interconnecting pins extending upwardly and respectively through said lateral slots between holders; and said manipulating means comprises an actuating link extending centrally along said series of holders and above said frame, a rotating link for each holder respectively rotatably mounted to said frame at axis of rotation for said holder, a cross actuating link for each pair of holders connected centrally thereof to said actuating link respectively generally between said holders and pivotally connected at the ends thereof respectively to said rotating links at alternately opposite sides of said frame whereby longitudinal movement of said actuating link along said series of holders will cause said rotating links to rotate in alternately opposite directions, a pair of slot links for each pair of holders pivotally interconnected at one end thereof by a slot link pin extending downwardly from said slot links and respectively through said lateral slots in said frame and adapted to respectively pivotally interconnect said holders below said frame to pivotally connect said holder together as a series of holders below said frame, each pair of said slot links having the other end thereof respectively pivotally connected to the ends of adjacent slot links and said rotating links at alternate sides of said frame throughout said series of holders to provide a series of linkages connected to said rotating links at the ends thereof opposite the pivotal connection thereof with said hangers of said holders; whereby movement of said actuator link along said frame will cause said rotating links of each pair of holders to rotated in opposite directions with said slot links balancing the force of said actuator link on said holders with said holder links moving in said circular slots and said slot links moving in said lateral frame slots to urge said holders to a alternate position.

* * * * *